US009307792B2

(12) United States Patent
Crissman

(10) Patent No.: US 9,307,792 B2
(45) **Date of Patent: *Apr. 12, 2016**

(54) UNDERWEAR BRIEF

(71) Applicant: Roger Crissman, Santa Cruz, CA (US)

(72) Inventor: Roger Crissman, Santa Cruz, CA (US)

( * ) Notice: Subject to any disclaimer, the term of this patent is extended or adjusted under 35 U.S.C. 154(b) by 23 days.

This patent is subject to a terminal disclaimer.

(21) Appl. No.: 14/457,804

(22) Filed: Aug. 12, 2014

(65) Prior Publication Data

US 2015/0047108 A1 Feb. 19, 2015

Related U.S. Application Data

(63) Continuation-in-part of application No. 13/968,806, filed on Aug. 16, 2013, now Pat. No. 9,204,672.

(51) Int. Cl.
*A41B 9/02* (2006.01)

(52) U.S. Cl.
CPC ..... *A41B 9/026* (2013.01)

(58) Field of Classification Search
CPC ..... A41B 9/007; A41B 9/023; A41B 9/026; A41B 9/002
See application file for complete search history.

(56) References Cited

U.S. PATENT DOCUMENTS

| | | | | |
|---|---|---|---|---|
| 2,138,481 A | | 11/1938 | Chatfield | |
| 2,282,218 A | | 5/1942 | Flesh | |
| 3,119,120 A | * | 1/1964 | Faust | A41B 9/02 2/234 |
| 4,195,630 A | | 4/1980 | Connery et al. | |
| 4,955,088 A | * | 9/1990 | Terjesen | A41B 9/02 2/403 |
| 4,961,419 A | | 10/1990 | Tribble et al. | |
| 5,870,779 A | | 2/1999 | Heron | |
| 6,061,839 A | * | 5/2000 | Smolik | A41F 13/471 2/400 |
| 6,415,450 B1 | | 7/2002 | Lien | |
| 2005/0235399 A1 | | 10/2005 | Kang | |
| 2015/0047107 A1 | * | 2/2015 | Crissman | A41B 9/023 2/403 |

FOREIGN PATENT DOCUMENTS

| | | |
|---|---|---|
| GB | 459968 A | 1/1937 |
| JP | 2645808 B2 | 8/1997 |
| JP | 2004256978 A2 | 9/2004 |

* cited by examiner

*Primary Examiner* — Anna Kinsaul
(74) *Attorney, Agent, or Firm* — Donald R. Boys; Central Coast Patent Agency, Inc.

(57) ABSTRACT

A male underwear garment has a waistband, fabric material joined circumferentially to the waistband, contiguously forming a back panel and a front panel, a first and a second leg opening for a person's two legs, and a horizontally oriented and aligned fly comprising a horizontal linear opening in the front panel of a width positioned at a height on the front panel to be, when worn, substantially even with a user's genitalia, the fly comprising an added flap panel of at least the width of the horizontal linear opening, sewn over the horizontal linear opening on three edges of the added flap panel, top and both sides, left open at a bottom edge below the horizontal linear opening, such that access is upward into the garment.

4 Claims, 15 Drawing Sheets

UNDERWEAR BRIEF

CROSS-REFERENCE TO RELATED DOCUMENTS

The present application is a Continuation In Part (CIP) to co-pending patent application, U.S. Pat. No. 13/968,806 entitled, "Underwear Brief", filed on Aug. 16, 2013, disclosure of which is incorporated herein in its entirety by reference.

BACKGROUND OF THE INVENTION

1. Field of the Invention

The present invention is in the field of garments and is more particularly related to an undergarment for men.

2. Description of Related Art

Various forms of undergarments have been developed over the ages for men. The currently available briefs for men are generally constructed with one or more trunk panels and overlapping front panels. The overlapping front panels typically define a singular fly opening for access through the outermost panel to the penis for the purpose of urination. Several attempts have been made to solve the numerous problems associated with the known brief constructions, such as discomfort, lack of support and embarrassment due to unsightly bulging or slippage of the male genital organs. Hence there is clearly a need for a male underwear brief with various options for supporting and exposing the male genital organ in different ways and to provide a comfortable wearing for 24 hours continuously in a day.

BRIEF SUMMARY OF THE INVENTION

In an embodiment of the invention a male underwear garment is provided having a waistband, fabric material joined circumferentially to the waistband, contiguously forming a back panel and a front panel, a first and a second leg opening for a person's two legs, and a horizontally oriented and aligned fly comprising a horizontal linear opening in the front panel of a width positioned at a height on the front panel to be, when worn, substantially even with a user's genitalia, the fly comprising an added flap panel of at least the width of the horizontal linear opening, sewn over the horizontal linear opening on three edges of the added flap panel, top and both sides, left open at a bottom edge below the horizontal linear opening, such that access is upward into the garment.

In one embodiment the garment is fabricated from stretch material, providing a snug-fit boxer garment. Also in one embodiment the snug-fit garment further comprises a first elastic band joined continuously along a lower edge of the horizontal linear opening. Also in one embodiment the snug-fit garment further comprises a second elastic band joined continuously along an upper edge of the horizontal linear opening. In yet another embodiment the snug-fit garment further comprises a forward-facing pouch extending from the front panel, the pouch substantially the width of the fly opening, and formed above the fly opening.

In an alternative embodiment the garment is a men's brief fabricated from passive fabric, the brief having leg openings with reinforced edges, and wherein the horizontal linear opening and the added flap panel extend from the reinforced edge of one leg opening to the reinforced edge of the other leg opening. In one embodiment the brief garment further comprises a first elastic band joined continuously along a lower edge of the horizontal linear opening and stitched to the reinforced edges of both leg openings. Also in one embodiment the brief garment further comprises a second elastic band joined continuously along an upper edge of the horizontal linear opening and stitched to the reinforced edges of both leg openings. And in another embodiment the brief garment further comprises a forward-facing pouch extending from the front panel, the pouch substantially the width of the fly opening, and formed above the fly opening. In one embodiment the brief garment further comprises a third horizontal elastic band joined only to each of the reinforced edges of the leg openings over the upper front panel above and parallel to the first and second horizontal elastic bands.

In still another embodiment the brief garment the upper front panel comprises material such that the upper front panel joined to the reinforced edges of the leg openings from the second elastic band upwards to a first point on the reinforced edges of the leg openings a specific distance along the reinforced edges of the leg openings from the lower edge of the second elastic band, and joined from above to the reinforced edges of the leg openings down to a second point on the reinforced edges of the leg openings lower on the leg openings from the first point creates an extension loop of two layers of material extending to the front a distance equal to the specific distance and ending in a folded edge, which extension, folded down along a line from the first point on the reinforced edges of the leg openings, positions the folded edge of the extension along the lower edge of the first and second elastic bands, and the extension, then joined to the reinforced edges of the leg openings, forms the pouch from inside the underwear brief. In another embodiment the pouch is formed by controlling the cut of the upper front panel to provide sufficient width such that the upper front panel, joined to the reinforced edges of the leg openings, provides the forward extending pouch.

In one embodiment of the undergarment the pouch is formed by stitching three or more pieces of fabric into a pouch shape having a planar outer periphery, cutting out a region in the front panel of the underwear garment of the size of the outer periphery of the pouch, and stitching the pouch to the front panel around the planar outer periphery. And in yet another embodiment the pouch and the horizontal fly are formed as a separate assembly having a planar outer periphery, cutting out a region in the front panel of the underwear garment of the size of the outer periphery of the separate assembly, and stitching the separate assembly to the front panel around the planar outer periphery.

BRIEF DESCRIPTION OF SEVERAL VIEWS OF DRAWINGS

FIG. 1*a* is a side perceptive view of a male underwear brief, according to an embodiment of the present invention.

FIG. 1*b* is a cross-section through a fly of the brief of FIG. 1*a*, according to an embodiment of the invention.

FIG. 1*c* is through a fly of the brief of FIG. 1*a*, according to an embodiment of the invention.

Figure 8A:
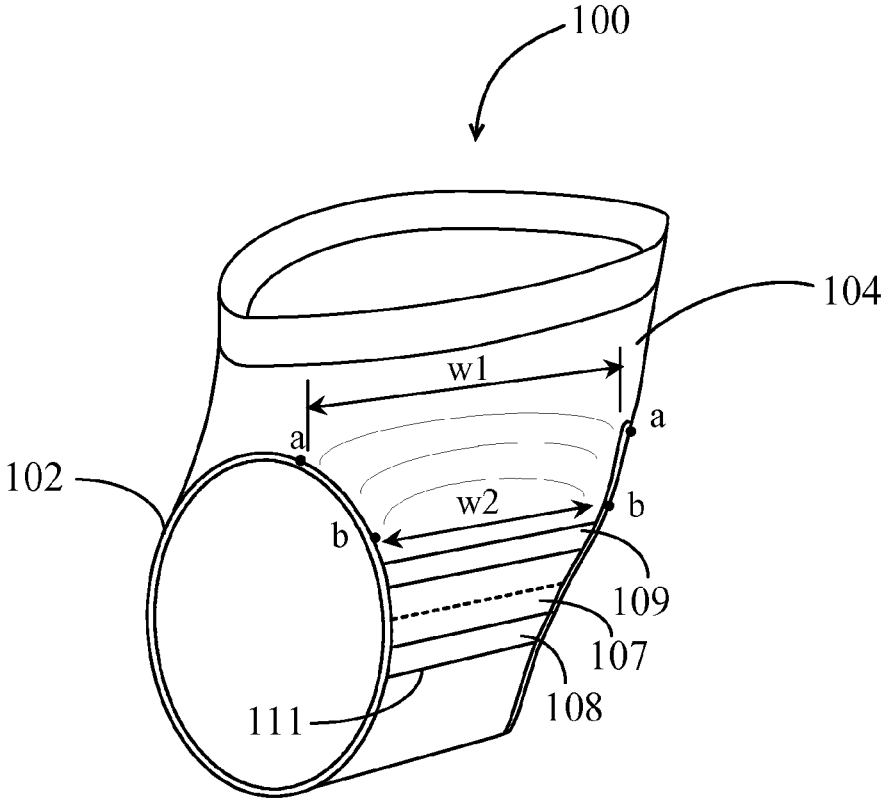

FIG. 8*a* is a side perceptive view of a male underwear brief illustrating an alternative process for making a pouch, according to an embodiment of the present invention.

Figure 8B:
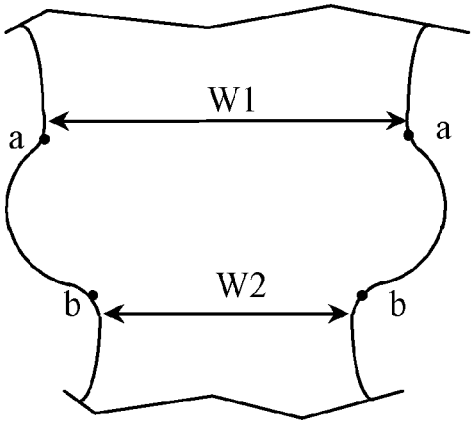

FIG. 8*b* illustrates a fabric cut useful in the process of FIG. 8*a*.

Figure 9:
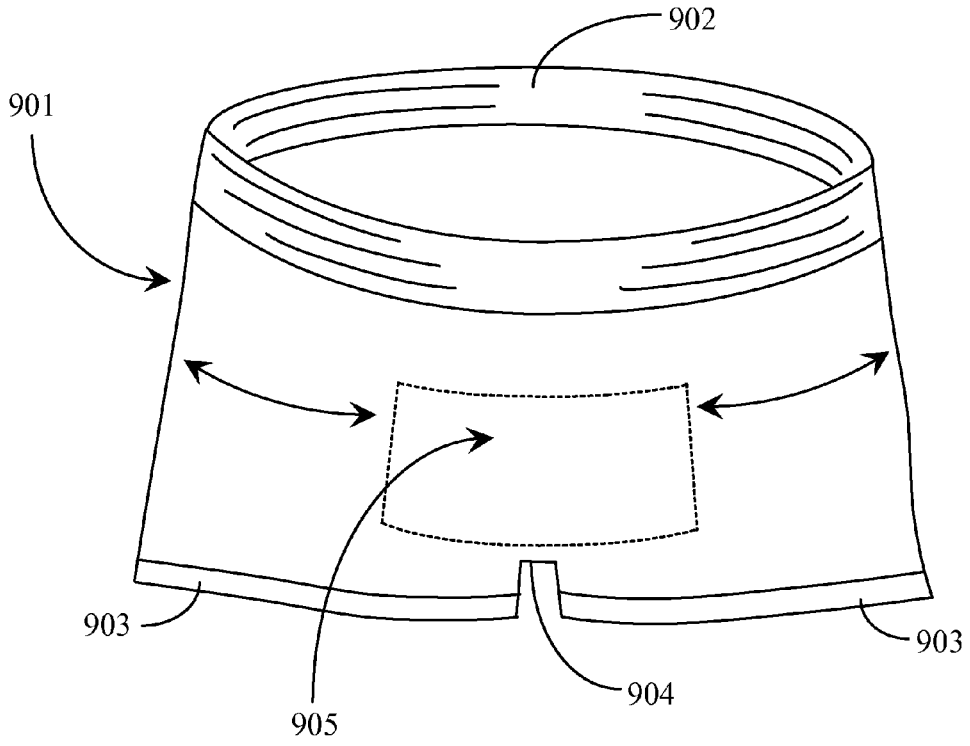
Fig. 9 (Prior Art)

FIG. 9 illustrates a snug-fit male underwear garment known in the art.

Figure 10:
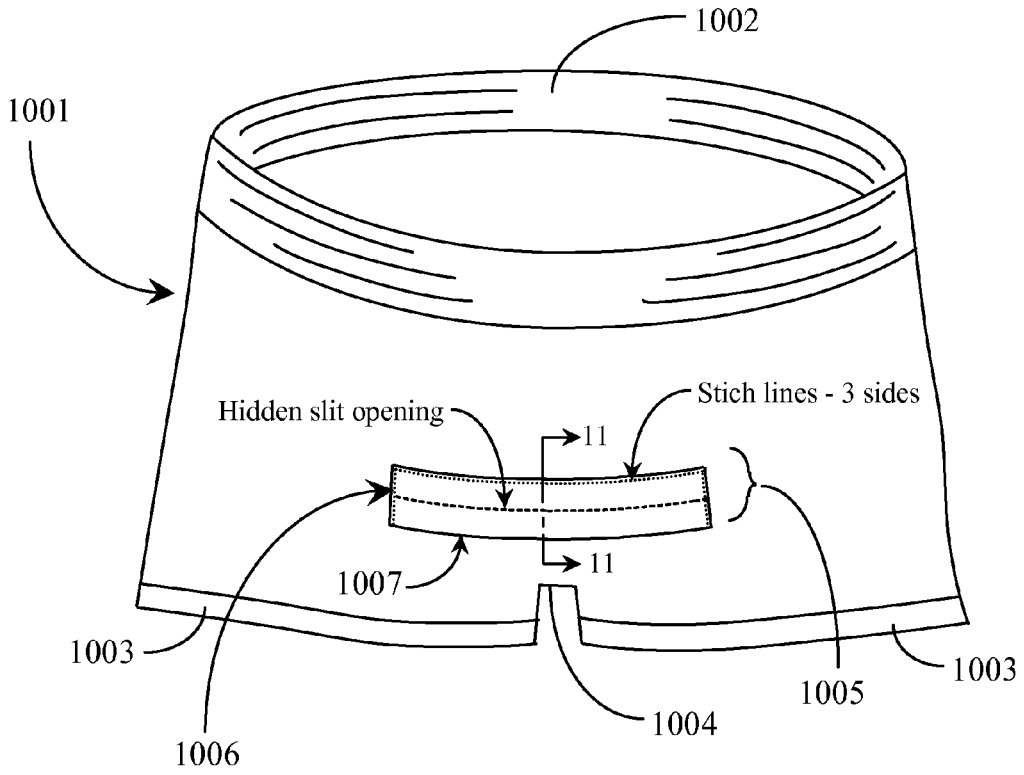

FIG. 10 illustrates a snug-fit underwear garment in an embodiment of the invention.

Figure 11:
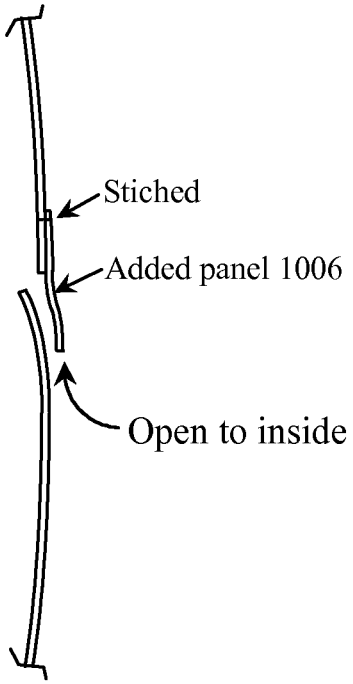

FIG. 11 is a cross-section view taken along line 11-11 of FIG. 10.

Figure 12:
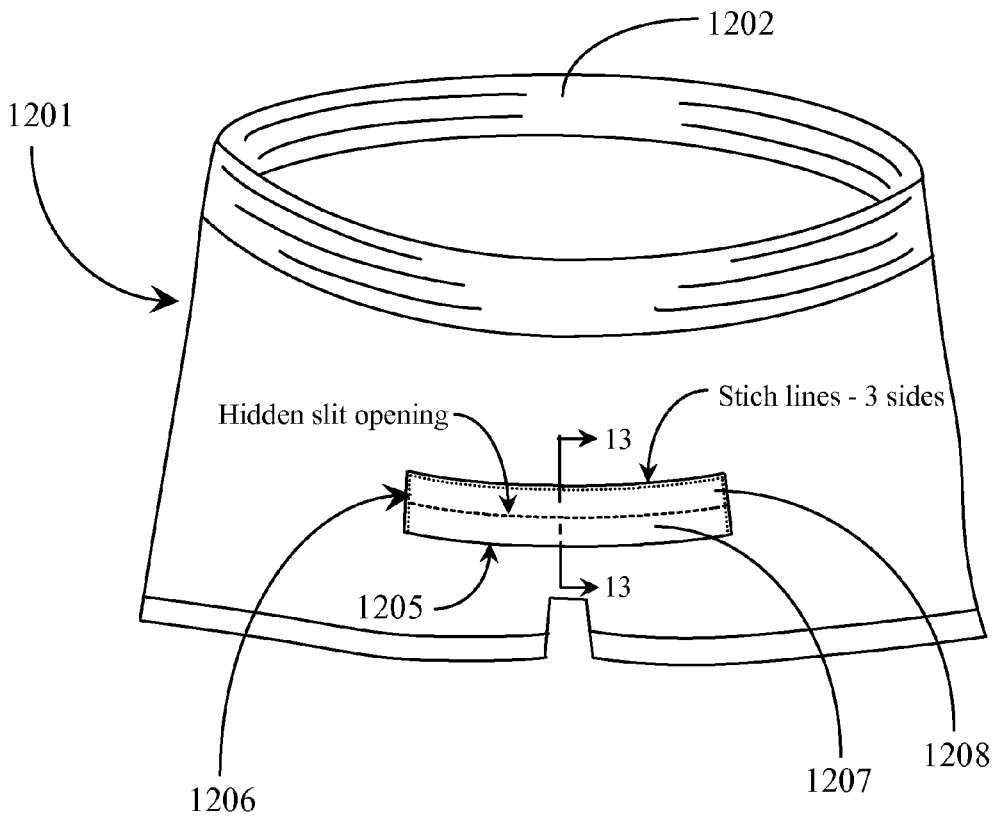

FIG. 12 illustrates a snug-fit underwear garment in another embodiment of the invention.

Figure 13:
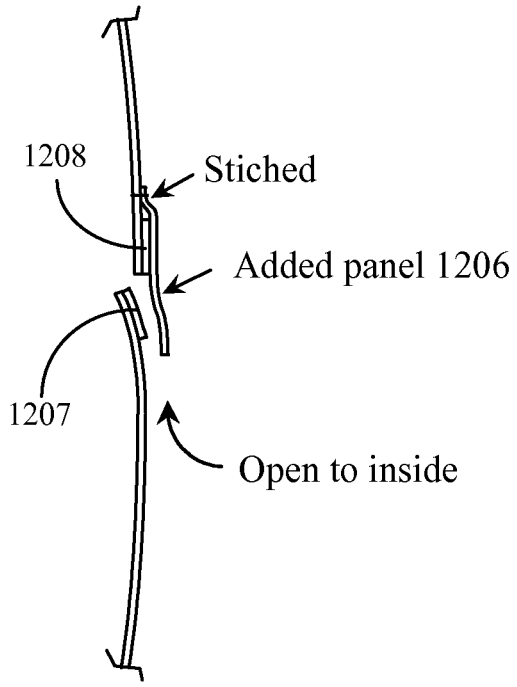

FIG. 13 is a cross section view taken along line 13-13 of FIG. 12.

Figure 14:
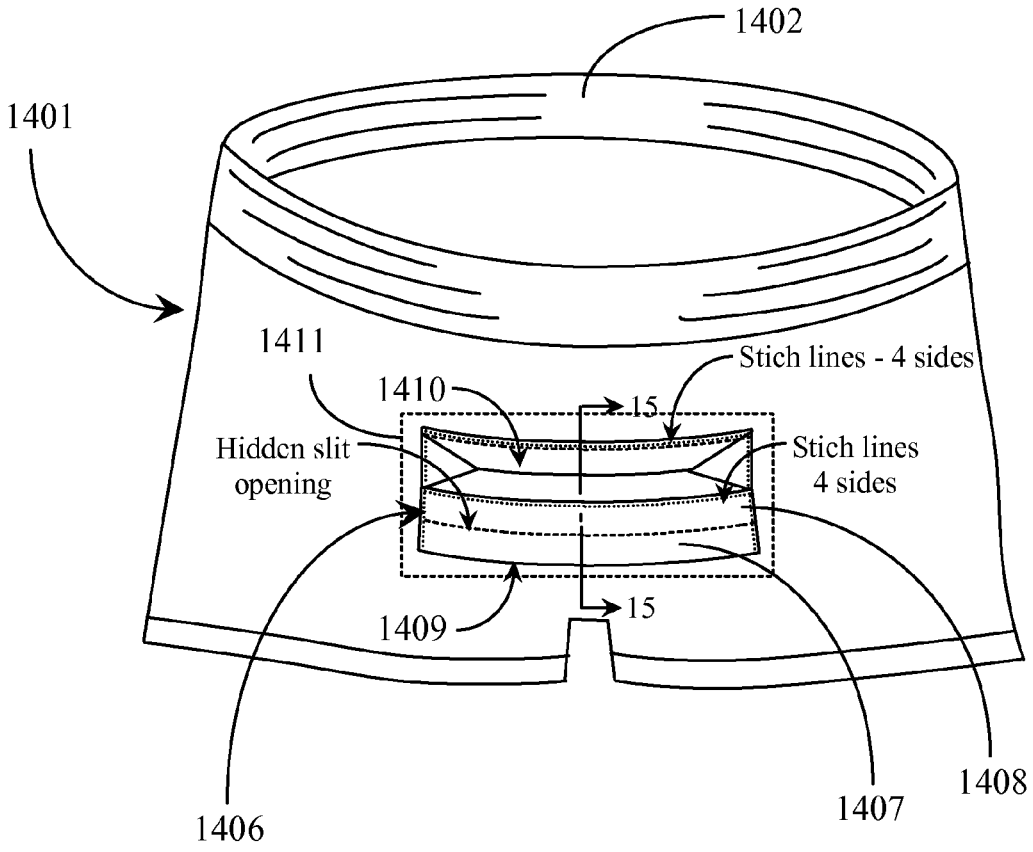

FIG. 14 illustrates a snug-fit underwear garment in another embodiment of the invention.

Figure 15:
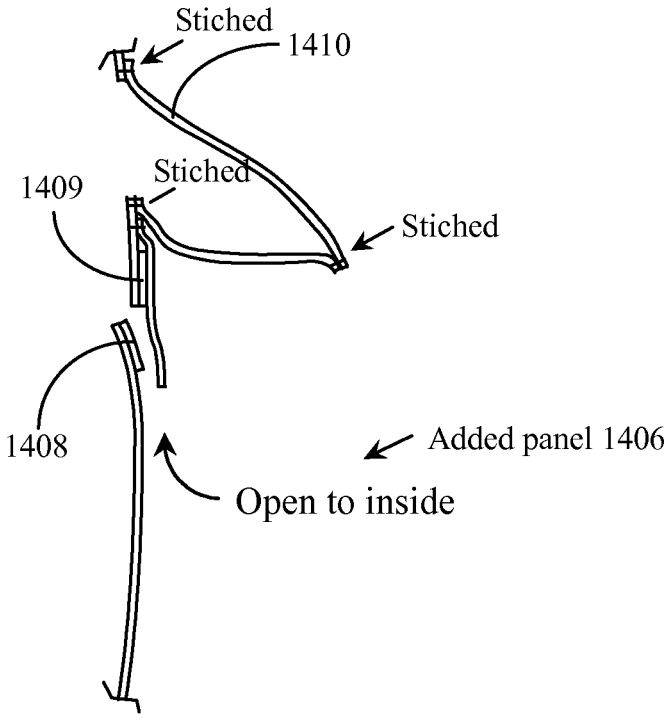

FIG. 15 illustrates a section view taken along line 15-15 of FIG. 14.

DETAILED DESCRIPTION OF THE INVENTION

Figure 1A:
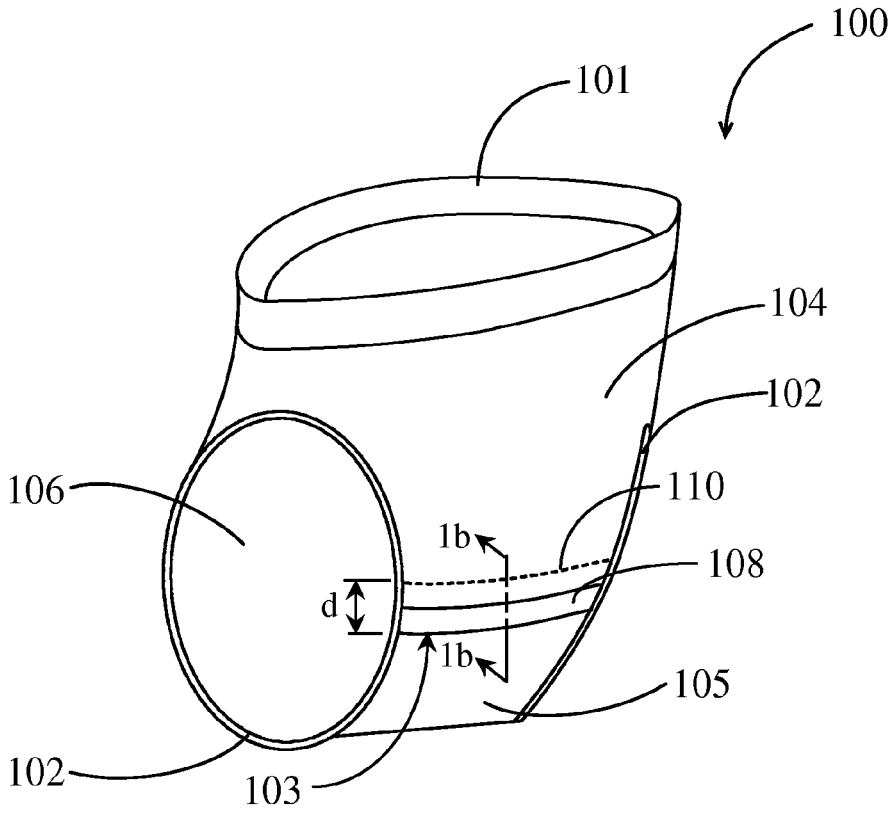

FIG. 1*a* is a side perspective view of a male underwear brief 100, according to an embodiment of the present invention. Male underwear brief 100 comprises an elastic waistband 101 attached to the upper periphery of the brief 100, cloth material joined circumferentially to waistband 101 which forms a back panel 106, an upper front panel 104, and a crotch panel 105 proceeding from a lower region of the back panel 106 to the front and upward, a first and a second opening 102 for a person's legs and a horizontally oriented and aligned fly opening 103. The edges of the first and the second openings 102 for the person's legs are reinforced in most embodiments, and in most cases the reinforced edges are of elastic material.

The horizontal fly opening 103 in the garment features a symmetrical slit-aperture that is cushioned, flexible and held close to the user's torso, where it can be positioned below, between or above a user's genitalia. When the genitalia is inside the garment above the fly, the slit-aperture closes under their overhanging weight. Since the fly opening has no fasteners, a user can easily pull the scrotum, or the penis and scrotum, out through the fly, which forms a soft collar around the base of the organs. In most embodiments the cloth material is stretchy and cut to accommodate changes in size and positioning of men's genitals. In one embodiment horizontally oriented and aligned fly opening 103 is positioned low in the front of brief 100. Back panel 106 and crotch panel 105 are joined to reinforced edges of the leg openings 102. The upper front panel is joined to the reinforced edges of leg openings 102 as well, and ends at a horizontal elastic band 108 attached continuously to upper front panel 104. Horizontal elastic band 108 is attached to each of the reinforced edges of leg openings 102.

In one embodiment the upper extent of the material of crotch panel 105 is at line 110. This creates an overlapped fly opening 103 open from below upward into the brief, of a vertical dimension "d". This dimension may vary depending on the placement of both the upper end of the crotch panel, and the lower end of the upper front panel.

Figure 1B:
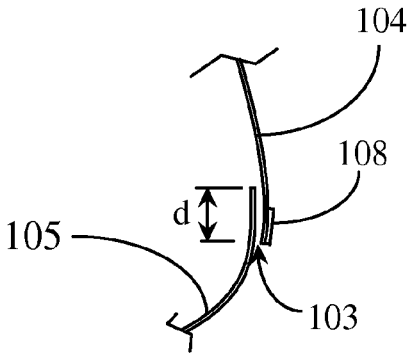

FIG. 1*b* is cross-section through horizontal fly 103 of FIG. 1*a* taken along section line 1*b*-1*b* into the brief. In this particular embodiment there is elastic band 108 overlying the upward-extending crotch panel material 105, but there is no band on the upper edge of crotch panel 105, which ends at line 110 (see FIG. 1*a*). In some cases this edge may be hemmed. Again, the placement and attachment of the crotch panel material and the upper panel material determine dimension "d", which may vary accordingly. The embodiment represented by FIG. 1*b* may be considered a "one-band" embodiment. In yet another embodiment upper front panel 104 may end without an elastic band, at an edge that may be, for example, hemmed as well, and this particular embodiment may be considered a "no band" embodiment, but nevertheless creates an upwardly opening overlapped horizontal fly opening of dimension "d".

Figure 1C:
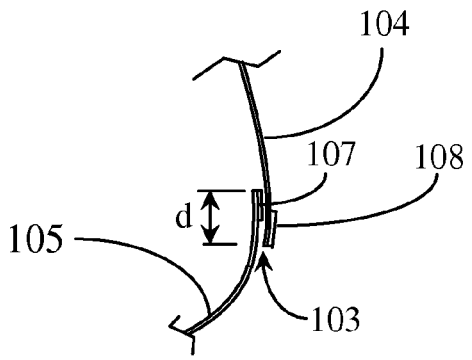

FIG. 1*c* illustrates the cross-section of the fly panel in another embodiment, wherein another elastic band 107 is added at the upper edge of the crotch panel. The elastic bands may be of equal height and weight, or different, and the overlap may be variously managed as described above. The embodiment represented by FIG. 1*c* may be considered a "two-band" embodiment. At least one other two-band embodiment is described additionally below.

Figure 2:
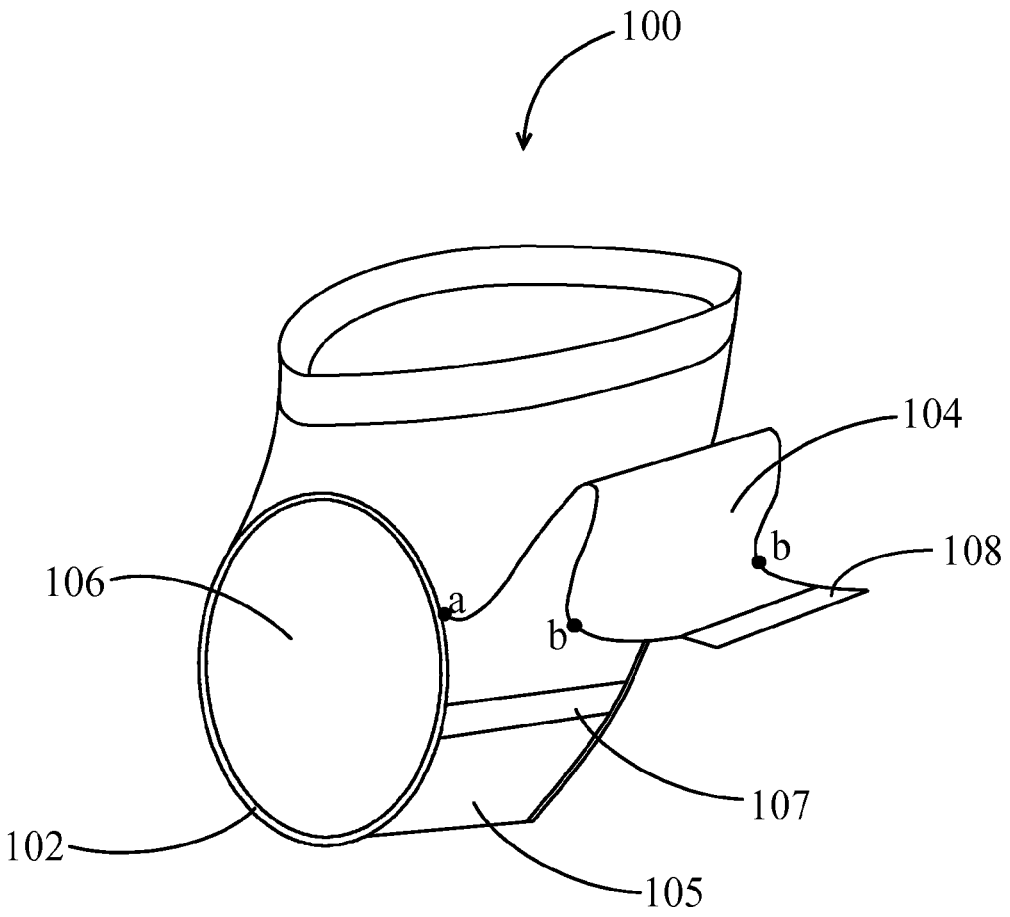
FIG. 2 is a side perceptive view of a male underwear brief indicating an upper front panel in an open condition, according to an embodiment of the present invention.

FIG. 2 is a side perspective view of male underwear brief 100 illustrating another embodiment of a "two-band" brief, wherein a front pouch is also provided, not shown in the embodiments of FIGS. 1*a*, 1*b* and 1*c*. To better illustrate how a pouch is formed with the upper front panel, the upper front panel in shown in an open position and in subsequent stages of assembly in FIGS. 2, 3, 4 and 5, according to an embodiment of the present invention. Crotch panel 105 proceeds upward from a lower region of back panel 106 to the front and ends at a first horizontal elastic band 107 joined securely to each of first and second leg openings 102, as shown in FIG. 1*c*. At this stage of assembly edges of upper front panel 104 are stitched to the elastic leg bands 102 down to point (a) as shown in FIG. 2. Note that point (a) is repeated on the opposite leg opening, although not seen in FIG. 2. The bottom edge of upper front panel 104 ends at and is joined to a second horizontal elastic band 108 as shown in FIG. 2.

Figure 3:
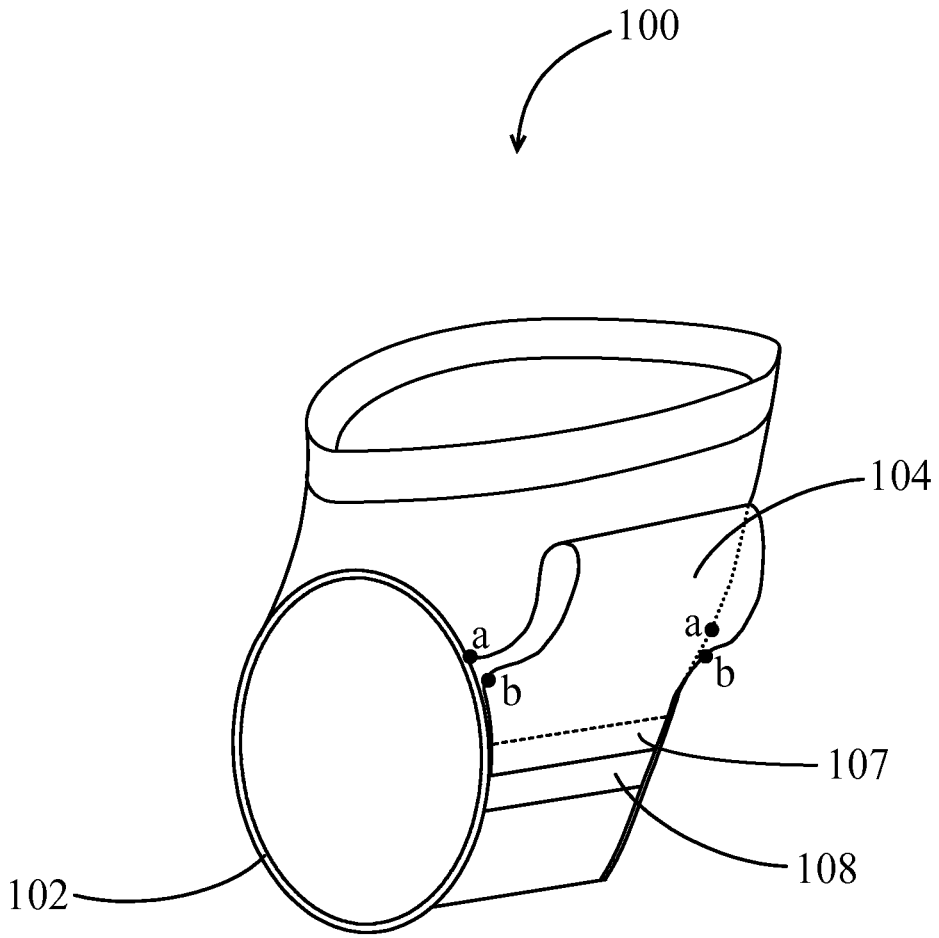
FIG. 3 is a side perceptive view of a male underwear brief indicating the upper front panel in a fixed and stitched condition, according to an embodiment of the present invention.

FIG. 3 is a side perspective view of male underwear brief 100, illustrating the upper front panel in a partly fixed condition, according to an embodiment of the present invention. One side of upper front panel 104 is joined to the leg openings on both sides at two different points (a), (b) to form an extended loop as shown in FIG. 3. The opposite edges of horizontal elastic band 108 are stitched respectively to the reinforced edges of leg openings 102 at the opposite sides, and are positioned in one embodiment below the position of band 107, as seen in FIG. 1*c*. This is optional placement in different embodiments, and the position of band 108 may vary, affecting the dimension "d", FIGS. 1*b* and 1*c*. Finally, the edges of the upper front panel pouch are stitched to the reinforced edges of the leg openings as shown, down to the horizontal fly.

First horizontal elastic band 107 and second horizontal elastic band 108 are only stitched to the edges of the leg openings 102, leaving an opening up from the bottom of the horizontal fly to the inside of the brief.

Figure 4:
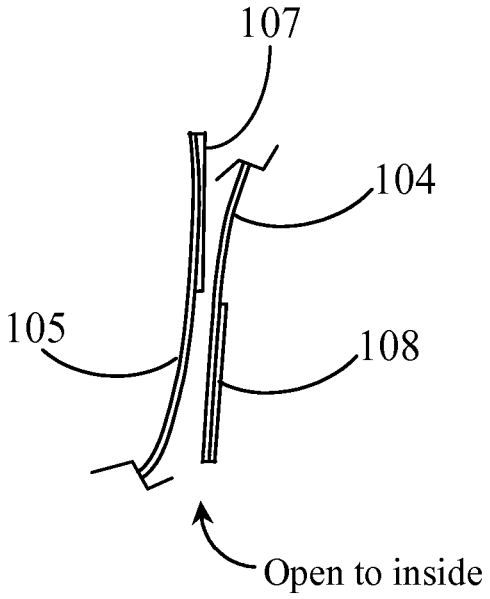
FIG. 4 is a cross sectional view of a male underwear brief indicating the arrangement of first horizontal elastic band and the second horizontal elastic band, according to an embodiment of the present invention.

FIG. 4 is a cross sectional view of the male underwear brief, essentially the same as FIG. 1*c*, illustrating the arrangement of the two horizontal elastic bands in this example. The bands are only stitched to the elastic leg bands 102. This leaves an opening up from the bottom of the fly to the inside of the upper front panel as shown in FIG. 4.

Figure 5:
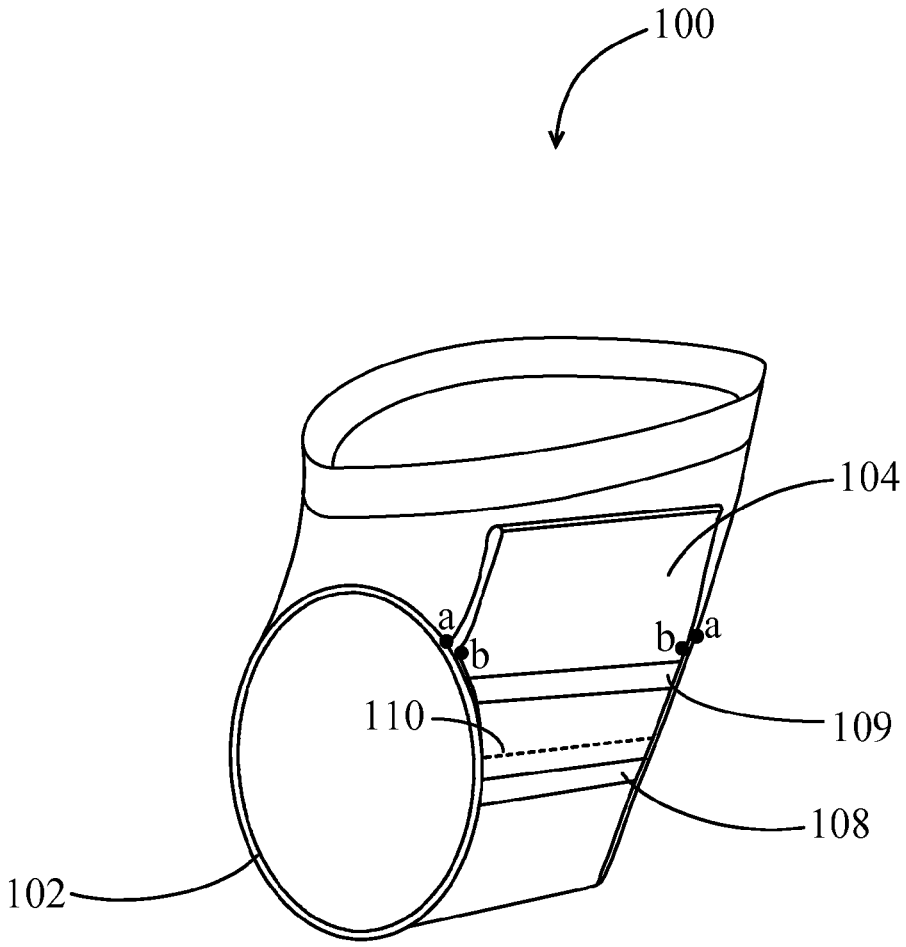
FIG. 5 is a side perceptive view of a male underwear brief indicating the arrangement of third horizontal elastic band, according to an embodiment of the present invention.

FIG. 5 is a side perspective view of male underwear brief 100, illustrating the placement of a third horizontal elastic band 109, according to an embodiment. The upper front panel is folded, as shown in FIG. 3, with point (a) and point (b) relatively close together in this example, on both leg openings as shown. Third horizontal elastic band 109 is joined only to each of the reinforced edges of the leg openings 102 and extends across the outside of the upper front panel 104 just above and parallel to second horizontal elastic band 108. The position of band 109 is below the attachment points (b) intentionally to provide support in use, as the pouch is intended to support a user's organ or organs.

Third horizontal elastic band 109 is stitched above second horizontal elastic band 108 and below attachment points (b) to each of the reinforced edges of the leg openings 102, but not to the upper front panel 104 or anywhere else. Since the third horizontal elastic band 109 is stitched only to the reinforced edges of the leg openings 102, it can be pulled outward. In alternative embodiments points (b) may be positioned on the edges of the leg openings further below points (a), providing a lower opening from inside into the pouch that is formed by the folded material, and the third horizontal elastic band 109 may be stitched continuously across the upper front panel, inside or outside.

Figure 6:
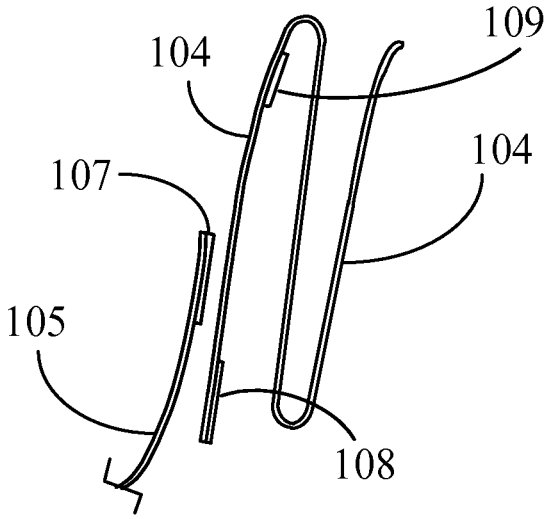
FIG. 6 is a cross sectional view of a male underwear brief indicating the arrangement of first horizontal elastic band, the second horizontal elastic band and the third horizontal elastic band, according to an embodiment of the present invention.

FIG. 6 is a cross sectional view of the male underwear brief illustrating the arrangement of the three horizontal elastic bands in this example. Crotch panel 105 proceeds upwardly from a lower region of the back panel to the front and ends at first horizontal elastic band 107 attached continuously to the crotch panel and to each of the reinforced edges of the leg openings. Upper front panel 104 is joined to the reinforced edges of the leg openings and ends at horizontal elastic band 108 attached continuously to the upper front panel. Band 108 is attached to each of the reinforced edges of leg openings typically at some distance below band 107. This leaves an opening up from the bottom of the horizontal fly to the inside of the upper front panel 104 as shown in FIG. 6. In alternative embodiments the position of band 108 may be varied from directly over band 107 to substantially below band 107, varying the vertical dimension of the upwardly-extending opening into the brief. Band 109 is stitched above and parallel to band 108 to each of the reinforced edges of the leg openings at a distance that may vary, but is typically placed to support the pouch developed as shown in FIG. 5.

Figure 7:
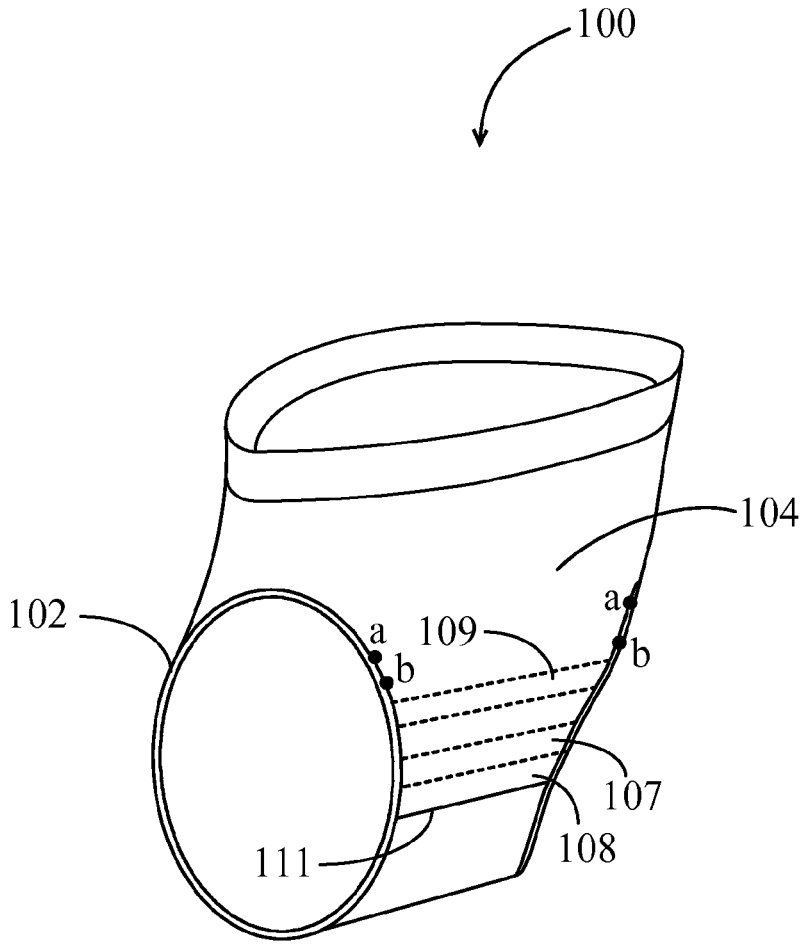
FIG. 7 is a side perceptive view of a male underwear brief with the upper front panel in closed position, according to an embodiment of the present invention.

FIG. 7 is a side perspective view of male underwear brief 100 with the fold of the upper front panel in a final position. The extended loop of upper front panel 104, as illustrated in FIGS. 3 and 5, has been folded downward. The folded loop is brought down, and the top edge of the loop comes right to the bottom edge of horizontal elastic band 108 at line 111. The side edges of the loop are stitched along the reinforced edges of the leg openings down to the horizontal fly thereby forming a pouch entry from within the brief along a horizontal line from points (a) and (b) on each leg opening. The relative positions of bands 107, 108 and 109 are shown now in FIG. 7 as dotted lines, because they are behind the folded down pouch material. It should be noted that the extent of material 104 may be adjusted, depending on a chosen distance between points (a) and (b), which define an opening size into an internal pouch, to provide the proper placement of edge 111.

In still another embodiment of the invention a front pouch may be formed by fabric cut, rather than by folding the fabric of the upper front panel as described in detail above. FIG. 8*a* is a perspective view of the brief showing horizontal elastic bands 107, 108 and 109. In this embodiment upper panel 104 is cut to provide a width w1 across points (a) to establish a dimension across the front of the brief, and another width w2 across points (b) below point (a) for the same purpose. W1 and w2 will typically be not the same, but w1 greater than w2.

FIG. 8*b* illustrates an exemplary cut for upper front panel material 104 with points (a) and (b) and widths w1 and w2. The edges are curved outwardly as shown between points (a) and (b). It is essential that the distance along the curve of the cut fabric from points (a) and (b) on each side be the same distance as between (a) and (b) on each leg band of the brief. This way, when the fabric is sewn to the leg bands on each side an outwardly-extending pouch may be formed. This pouch in use supporting a user's organ or organs will tend to form outwardly and downward as well.

Horizontal fly 103 can be stretched more than 25% to let the penis and scrotum out, or to just let the scrotum out, and to provide a slack-line-type closure for a supportive upper pouch (i.e. for upper front panel 104) to hold the penis, or the penis and scrotum. When one or both organs are pulled out through vertically-symmetrical, horizontal fly 103, the fly creates a comfortable collar close to the user's torso, and the second horizontal elastic band 108 shrouds 1'-2' of the exposed organ(s), like a full-width fabric eyebrow. The first, second and third elastic bands may have a width of from ¼"-⅝" and are wrapped up for comfort in the fabric of brief 100 or other suitable material.

In one embodiment, the male underwear brief in this example provides various options for the person to provide a continuous comfortable wearing for 24 hours every day. In one option the pouch formed of the extra material of the upper front panel covers and lifts both the penis and the scrotum, while slit-aperture horizontal fly 103 closes under the overhanging weight of the penis with the scrotum under. The pouch formed with the extended loop of the extra material of the upper front panel absorbs urine, reduces rolling and squeezing of organs between thighs and looks similar to jocks/briefs worn worldwide. In a second option the pouch covers and lifts only the penis up, or to one side, while a slit-aperture (horizontal fly) 103 collars the scrotum. The scrotum may extend outside the brief which may be suitable for wear with most outerwear and in high humidity. In a third option horizontal fly 103 of the male underwear brief may let the penis out and collar the penis and the scrotum. The horizontal fly 103 further covers the pubic hair. The organs (penis and scrotum) may be pulled out and the buttocks region will stay covered without doffing the brief 100. With the penis and scrotum exposed through fly 103, a user need not remove brief 100 in order to sit on a toilet and urinate quickly and comfortably with no risk of urine accidently wetting the brief or the man's leg.

In an alternative embodiment of the present invention the horizontal fly and supporting pouch described in enabling detail above for a male underwear brief is applied to snug-fitting boxer male underwear shorts. FIG. 9 is a perspective front view of a pair of snug-fitting boxer male underwear shorts 901, comprising a stretch waistband 902 leg bands 903 and a small crotch panel 904. Boxer shorts of this sort are typically manufactured with two-way stretch material, but always at least one-way stretch material. The fact of the stretch material when the shorts are worn, ensures a relatively tight fit depicted in FIG. 9 by stretch arrows 905.

The depiction of FIG. 9 is simply exemplary, and there may be many variations in the known art. For example, the legs may be considerably longer than the legs as shown in FIG. 9. The waist may be considerably higher, or somewhat lower.

These differences have little or no influence on the fit of the garment across the genital area in front of the person wearing the boxer shorts.

Lastly an area 905 is depicted in FIG. 9, which denotes the fabric portion of the snug-fitting boxer shorts that overlies the genital area of the person wearing the boxer shorts. Region 905 is shown in dotted outline. Any fly opening in this area in snug-fitting boxer shorts is atypical and unusual. This is ostensibly because the stretch fabric providing the snug fit is thought to provide needed support for male genitalia. Further, a typical vertically-oriented fly opening would likely gap open due to the forces from the stretch fabric, and would defeat the snug-fit.

FIG. 10 depicts a pair of snug-fitting boxer shorts 1001 according to an embodiment of the present invention, having a waistband 1002, leg bands 1003, a crotch panel 1004, and a horizontally oriented fly arrangement 1005. In this embodiment a fabric panel 1006, preferably of the same or a similar stretch material used for the majority of the brief, is stitched to the fabric of the brief in a position as shown, the stitching accomplished on three sides of the added panel, top and both sides, leaving the bottom edge 1007 open. An edgewise slit is made in the main fabric below the added panel at a vertical position of about one-half of the height of the added panel. The result of the added panel, stitched on three sides to the main fabric, and the slit from side-to-side as shown, is a hidden fly opening of the sort described above for briefs. See FIGS. 1*b* and 1*c*. The lower unstitched edge of the added panel may be hemmed, and one or both sides of the slit opening may be hemmed as well. This provides a very easy to use horizontal fly opening in a men's snug-fitting boxer undergarment.

The slit opening is provided at a position on the front of the boxer undergarment that is close to the height position of the penis, so access to the slit is convenient. The slit may be from perhaps two to six inches in horizontal extent in different embodiments.

FIG. 11 is a cross section of the fly opening provided, taken along section line 11-11 of FIG. 10. Added panel 1006 is shown stitched at the top to the main fabric, which has been slit, providing a flapped opening up into the boxer undergarment, which a wearer may easily use to expose the penis for urination, for example. In some cases the edges of the slit opening may be hemmed, or treated in another manner to prevent unraveling of fabric, for example, but these sorts of treatments are not essential to the invention. Since this view is a section view, the side stitching of the added panel does not show. Further, the added panel being the same stretch material, or similar material, as the boxer shorts, the snug-fit characteristic should not be impaired in any way.

FIG. 12 illustrates a pair of snug-fitting boxer shorts in another embodiment of the present invention. The embodiment of FIG. 12 appears the same as that of FIG. 10 from the outside, but includes at least one, and in some cases two, elastic bands that may be stitched to the original fabric along the edges of the horizontal slit made in the original fabric.

FIG. 13 illustrates a cross-section of the slit and fly arrangement of FIG. 12 taken along line 13-13 of FIG. 12. In this embodiment an elastic band 1208, in length at least the length of the horizontal slit, is stitched or otherwise adhered to the original fabric along an upper edge of the slit opening. This elastic band strengthens the material along the slit and adds some extra fabric tension. In some embodiments a second elastic band 1207 is added along the lower edge of the slit opening. The added fabric panel 1206 is stitched to the original fabric above the added elastic band 1208, but may be stitched to the elastic band. Again, the side stitching does not show in this section view, but it may be understood that the added panel is stitched along the top and both sides, but left open at the lower edge.

FIG. 14 illustrates a pair of snug-fit boxer shorts in yet another embodiment of the invention. In this embodiment a front pouch 1410 is formed above the horizontal fly implemented in the boxer shorts. This pouch requires that a region of the original fabric be cut out within the region that the pouch is to be formed. The cutout may be essentially the size of the horizontal and vertical extent of the pouch, or somewhat smaller. A pouch is formed in this example from two or more pieces of fabric sewn together, which is then stitched to the original fabric on all four sides around the cut-out region. The nature of this pouch is better seen in cross section in FIG. 15.

FIG. 15 is a cross-section taken along section line 15-15 of FIG. 14. The horizontal slit providing opening to the outside is the same as in FIG. 14, including the added panel/flap that provides that the slit is hidden. Pouch 1410 is shown as stitched to the original fabric around the opening made in the original fabric above the added horizontal slit. The pouch is shown in FIG. 15 as having an upper and a lower panel stitched together at an outside extremity, but in other embodiments the upper and lower pieces seen may be one piece folded. The side panels seen in FIG. 14 are not seen in this cross-section view. In one embodiment there may be no side panels, and the upper and lower portions of the pouch may be gathered on the left and right edges and stitched together.

When not in use the added pouch may lie loosely on the front of the garment. The pouch provides a support for user's genitalia, either just the penis, or both the penis and the scrotum, which a user may place in or remove from the pouch easily. In one use the penis might be supported in the pouch, and the scrotum may extend to the outside through the horizontal fly, providing, for example, a cooling effect.

The skilled artisan will understand that the pouch may be constructed in a variety of ways to be added to the snug-fit boxer garment. In one embodiment a fabric assembly providing both a pouch and a horizontal slit fly opening may be separately manufactured and provided to customers to be easily added either by an end user or by a seamstress or tailor to an existing snug-fit boxer garment. In this embodiment the pre-manufactured assembly will have an outer periphery, typically substantially quadrilateral. The end user or tailor/seamstress need only mark the outline of the separate assembly on the front of the existing garment, cut out the marked section of the garment, and stitch the separate assembly to the garment around the periphery of the cut-out in the garment. FIG. 14 shows an exemplary extent 1411 for cut-out and addition as a dotted outline.

It will be apparent to a skilled artisan that the embodiments described above are exemplary only, and that there may be many alterations made in these examples without departing from the spirit and scope of the invention.

The invention claimed is:

1. A male underwear garment, comprising:

a waistband;

fabric material contiguously forming a back panel and a front panel;

a first and a second leg opening for a person's two legs; and a horizontally oriented and aligned fly comprising a horizontal linear slit opening having a width positioned at a height in the front panel to be, when worn, substantially even with a user's genitalia, the fly further comprising a flap panel of at least the width of the horizontal linear slit opening, the flap panel having an upper and a lower edge and two opposite side edges, the flap panel sewn to the front panel along the upper edge above the linear slit opening, sewn vertically along both side edges of the flap panel on each side of the linear slit opening, and left open, not sewn, along the lower edge below the horizontal linear slit opening, such that access is upward into the garment;

a forward-facing pouch formed in the front panel, substantially the width of the horizontal linear slit opening, and positioned above the horizontal linear slit opening;

a first elastic band sewn continuously along a lower edge of the linear slit opening along the full width of the linear slit opening;

a second elastic band sewn continuously along the lower edge of the flap panel for the full width of the flap panel; and a third elastic band having a horizontal length greater than or equal to the width of the linear slit opening, the third elastic band positioned higher on the front panel than the first and the second elastic bands and the flap panel, but below the forward-facing pouch, and sewn to the front panel at opposite ends of the width of the third elastic band.

2. The underwear garment of claim 1 wherein the garment is fabricated from stretch material, providing a snug-fit boxer garment.

3. The underwear garment of claim 1 wherein the garment is a men's brief, the first and second leg openings having reinforced edges, and wherein the horizontal linear slit opening, the added flap panel, and the elastic bands extend from the reinforced edge of the first leg opening to the reinforced edge of the second leg opening.

4. The underwear garment of claim 1 wherein the pouch comprises three or more pieces of fabric stitched into a pouch shape having a planar outer periphery, the front panel of the underwear garment comprises a cut out region the size of the outer periphery of the pouch, and the pouch is stitched to the front panel around the planar outer periphery.

* * * * *